US012297626B1

(12) United States Patent
Daly

(10) Patent No.: US 12,297,626 B1
(45) Date of Patent: May 13, 2025

(54) TRIPLE PURPOSE SOLAR PANEL CONDENSATION SYSTEM

(71) Applicant: Expro North Sea Limited, Aberdeen (GB)

(72) Inventor: Kerry G. Daly, Conroe, TX (US)

(73) Assignee: Expro North Sea Limited, Aberdeen (GB)

( * ) Notice: Subject to any disclaimer, the term of this patent is extended or adjusted under 35 U.S.C. 154(b) by 0 days.

(21) Appl. No.: 18/752,696

(22) Filed: Jun. 24, 2024

(51) Int. Cl.
*E03B 3/28* (2006.01)

(52) U.S. Cl.
CPC ..... *E03B 3/28* (2013.01)

(58) Field of Classification Search
CPC ..... E03B 3/28
See application file for complete search history.

(56) References Cited

U.S. PATENT DOCUMENTS

2020/0331323 A1* 10/2020 Perkinson ..... B60H 1/3414
2021/0354080 A1* 11/2021 Alejo ..... C02F 9/00
2022/0316192 A1* 10/2022 Friesen ..... B01D 53/265

* cited by examiner

*Primary Examiner* — Elizabeth J Martin
(74) *Attorney, Agent, or Firm* — Getz Balich LLC

(57) ABSTRACT

A triple purpose solar panel and water condensation system is provided. The system includes a solar panel for converting solar energy to electrical energy and a unique two-step water condensation system. The water condensation system is designed to have an upper condensation chamber performing the first step of the two-step condensation process and a lower condensation chamber performing the second step of the two-step condensation process. The system includes window with ports for air transfer, and independent, self-contained, hydraulic cylinders filled with hydraulic fluid, for opening and closing of the window ports to allow for atmospheric air flow to enter inside the condensation chamber.

20 Claims, 2 Drawing Sheets

TRIPLE PURPOSE SOLAR PANEL CONDENSATION SYSTEM

BACKGROUND OF THE DISCLOSURE

1. Technical Field

The present disclosure relates generally to green energy technology, applicable in the field of renewable energy and natural sources. More specifically, the present invention is a triple purpose energy module that provides a hybrid solar panel-interfaced unique two-step condensation process that utilizes solar technology to generate electrical energy and simultaneously a dual step condensation process to generate water from atmospheric air.

2. Background Information

As expanding energy use and environmental concerns have become of greater importance, interest has grown in available energy sources that are alternatives to fossil fuels, hydroelectric power and nuclear power. In today's alternate energy market, there are a number of different alternative energy systems being used. There are solar cells, known in the industry as photovoltaic cells, wind turbines which generate electricity using electrical generators driven by blades that catch the wind, solar furnaces which generate electricity using electrical generators driven by steam that is produced by catching and magnifying heat from the sun, hydrogen fuel cells which derive hydrogen from gasoline or methane, straight hydrogen motors for vehicles which burn hydrogen that is stored thereon, and electric cars which rely on batteries to power them. All the above technologies are still in nascent stages of development and have significant hurdles to overcome so that they could be applied industrially.

Water is the most valuable natural resource on Earth and the present-day shortage of water can be addressed in an environmentally friendly manner by extraction of water from atmospheric air by means of passive condensation. General techniques of water condensation include the process where moisture in air is converted to water. Condensation can happen when the air gets cooled to its dew point. Even though the idea of reducing atmospheric moisture into liquid water is not new, approaches for direct extraction of water from atmospheric air have not been properly investigated and are yet to win commercial acceptance. The most simplified method for direct extraction and liquefication of water from atmospheric air is by direct condensation at ambient conditions. A second step of condensation can ensure formation of water with high purity. This unique two-step condensation process ensures water of high purity is obtained without having to remove impurities from water by additional steps of filtration and purification.

Even though water is the most valuable natural resource, at present the water sources are not sustainable and continue to decline both in capacity and purity. Rising pollution, increasing population and climate changes have intensified the water scarcity and purity problem. Simultaneously, increased reliance on fossil fuels has damaged the environment to alarming proportions and has depleted the fossil fuel supply to such an extent that there is a dire need to transition to a natural and renewable energy supply such as solar energy. The recent years have seen many advances in the making and using of solar energy for generation of electricity. Many systems have been developed for converting atmospheric air into water. Quite a few techniques are aimed at using solar energy in the process for collecting water of condensation, such as utilizing solar energy to promote endothermic reactions to condense atmospheric air, adsorption-desorption-condensation cycles to extract moisture from the atmospheric air, and the like.

Consequently, there is a need for development of a self-sustaining, continuous system, which is a simplified and effective technique operating on natural renewable sources of energy, making use of passive heat from the environment to convert solar energy to electric energy along with a unique self-driven two-step condensation process wherein, as a first step, the cooler nighttime air collects in a chamber, thus cooling the internal water reservoir and creating a cooling surface; and as a second step, as temperature rises during the day, moist air contacting the cooler surface causes condensation on the surface which falls into a water storage system to be channelized into a water distribution system for various purposes such as agricultural, and other uses.

SUMMARY

The present invention pertains to green energy technology and discloses a self-sustained, continuous system and method for using solar energy to generate electric energy and simultaneously collecting water from atmospheric.

The present invention employs a unique two-step condensation process to harness water from air wherein the first step occurs during nighttime when the atmosphere is cool, and the cool air enters inside a condensation chamber. The next step progresses in the daytime when the atmosphere is warm. The differential between cool water inside the condensation chamber and hot air outside causes condensation of water droplets on the outer surface of the condensation chamber. The water droplets drop into a water distribution system.

The method of the present invention further effectively uses the water formed by condensation to be contained in a reservoir for storage and/or agricultural and/or industrial use.

The large surface area of the solar panel of the present invention, in direct contact with sunlight, naturally creates a shaded area underneath, which would have lesser temperature than the outer area above the panel, thus creating a temperature differential. This can be used to create a microclimate underneath, suitable for agriculture, using the water collected by condensation for watering the crops. In comparison with conventional techniques, the system presents an efficient and passive, condensation process that utilizes solar technology to generate electrical energy and simultaneously a two-step condensation process to generate water from atmospheric air, thus making this approach unique, precise, environmentally friendly, natural and economical.

The present invention aims to achieve all the above benefits without the expense or environmental footprint of conventional methods of generation of electricity, and condensing water from atmospheric air and most uniquely, creating of a microenvironment for agriculture, in the most natural, environmentally friendly and efficient manner resulting in significantly reduced costs. The present invention does away with the conventional methods of generating electricity and water procurement and purification. Hence, environmental and ground water protection is achieved.

The foregoing summary is intended merely to introduce a subset of the features more fully described in the following detailed description. Accordingly, this summary should not be considered as limiting.

BRIEF DESCRIPTION OF DRAWINGS

The accompanying drawing, which is incorporated in and constitutes a part of this specification, illustrates an embodiment of the present teachings and together with the description, serves to explain the principles of the present teachings. In the figures.

DETAILED DESCRIPTION

Figure 1:
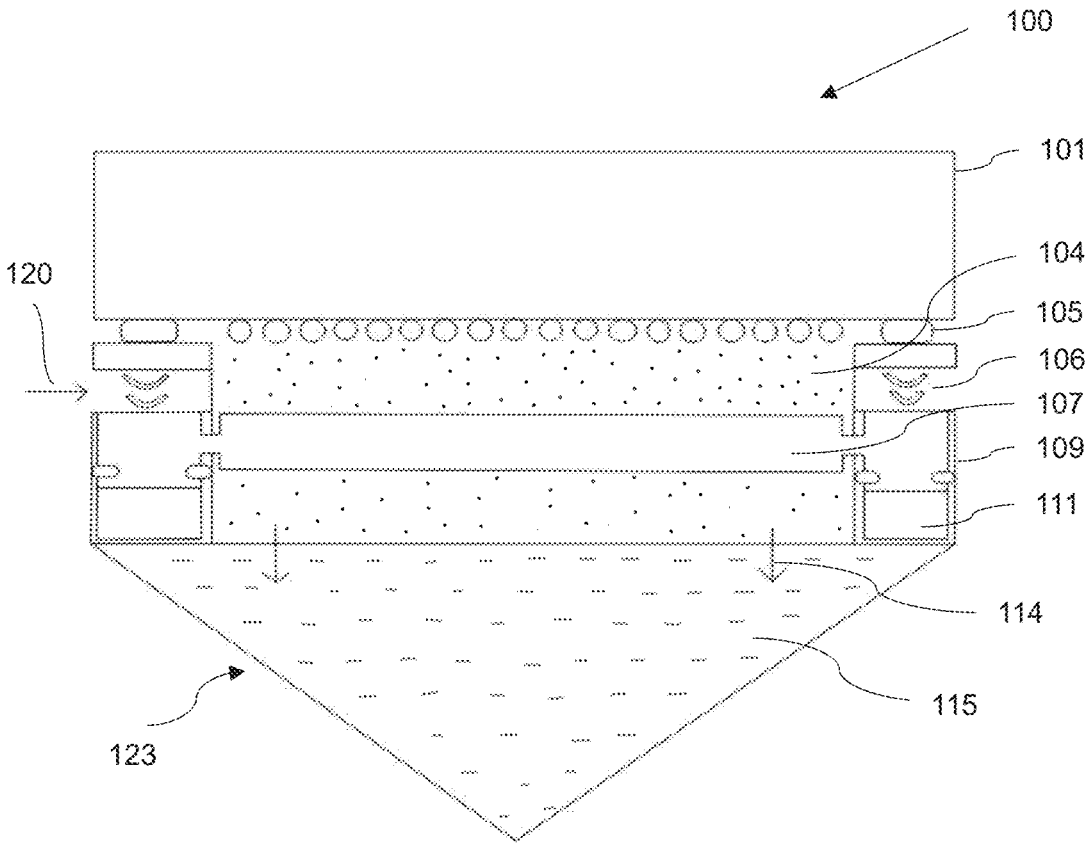
FIG. 1 is a perspective view of the passive water production system during nighttime.

Reference will now be made in detail to embodiments of the present teachings, examples of which are illustrated in the accompanying drawing. In the drawings, like reference numerals have been used throughout to designate identical elements, where convenient. The following description is merely a representative example of such teachings.

Embodiments of the present disclosure provide a system, method and apparatus for passive water production by means of a hybrid solar panel-interfaced unique two-step condensation process that utilizes solar technology to generate electrical energy and simultaneously a two-step condensation process to generate water from atmospheric air.

According to aspects of the present disclosure, FIG. 1 diagrammatically illustrates the triple purpose solar panel 100 during nighttime, when temperatures are comparatively low (e.g., having a first ambient temperature). The triple purpose solar panel 100 includes a conventional solar panel 101, which is used to absorb the light of the sun (e.g., solar radiation) during daytime to create electrical energy. The solar panel 101 has an add-on enhancement beneath it, which is a water condensation system. The water condensation system is a two-step water condensation system having two parts: an upper condensation chamber 104 and a lower inverted pyramid shaped condensation chamber 123. The upper condensation chamber 104 is situated on the upper part of the upper condensation system and performs the first step of the two-step condensation process. Window 107 including window ports 106 function for air transfer and is positioned on the upper part of the upper condensation chamber 104. Attached to windows 107, at each of the four corners, are independent, self-contained hydraulic cylinders 109 filled with hydraulic fluid 111 below, with internal springs, pistons, and o-rings for opening and closing the windows to allow for atmospheric air flow from outside to enter inside the upper condensation chamber 104. In the nighttime situation as illustrated in FIG. 1, the cool night (e.g., comparatively low) temperature causes the hydraulic fluid 111 of hydraulic fluid cylinders 109 to contract which causes the window 107 to descend such that the window ports 106 are open and exposed. This allows the cool night air (e.g., radiatively cooled ambient air; ambient air having the first ambient temperature) 120 from outside to enter the upper condensation chamber 104 through the open window ports 106. Water vapor within the radiatively cooled ambient air condenses to form water droplets 114 which are subsequently collected in the lower condensation chamber 123.

Figure 2:
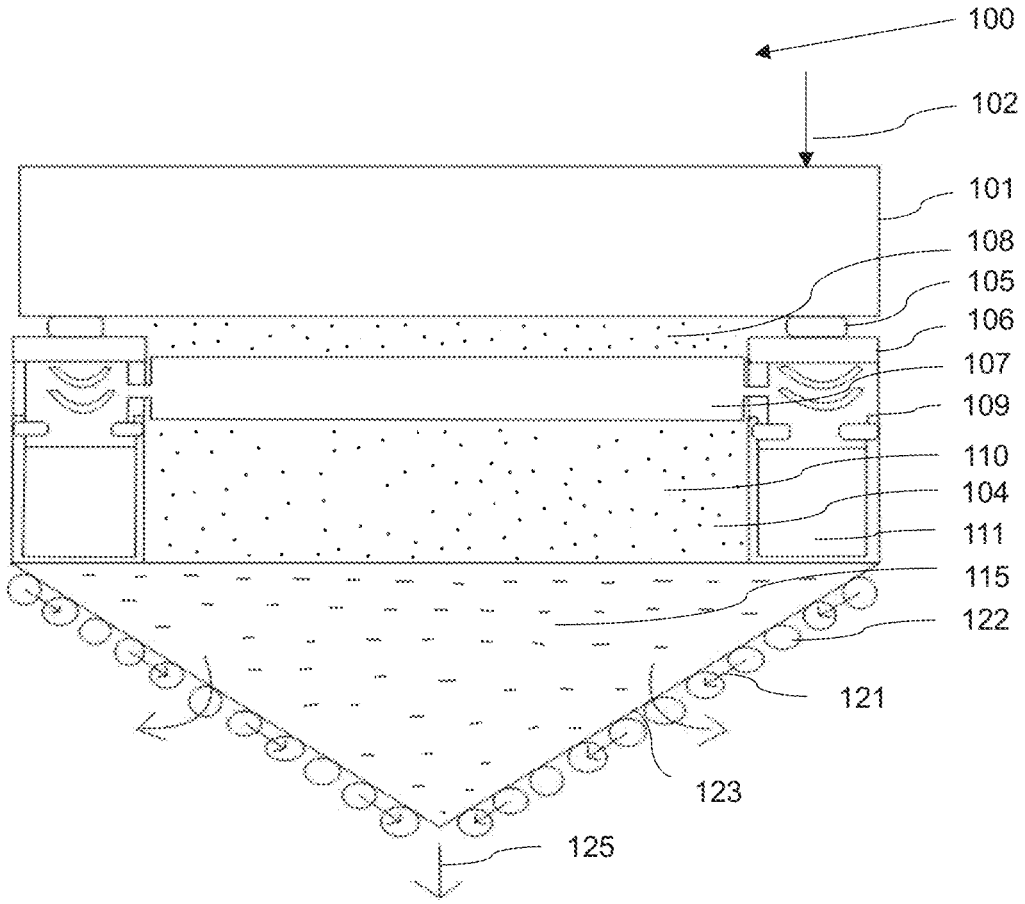
FIG. 2 illustrates the passive water production system during daytime.

During daytime, when temperatures are comparatively high (e.g., having a second ambient temperature greater than the first ambient temperature), which is illustrated in FIG. 2, as the sun's rays 102 are incident on the solar panel 101, the panel converts the solar energy into electrical energy. At the same time, the surface of solar panel 101 gets heated by the sun's rays 102. The hot temperature of the daytime (e.g., solar radiation) causes the hydraulic fluid 111 to expand and this pressure causes the hydraulic fluid cylinders 109 with spring and O-ring to get pushed up such that the window ports 106 get closed. The expansion of the hydraulic fluid 111 causes window 107 to go up such that the windows are closed and the hot air of the daytime (e.g., solar radiated ambient air; ambient air having the second ambient temperature) stays outside and is not able to enter upper condensation chamber 104. Sealing element 105 at the condensation chamber ensures proper sealing so that air transfer is not possible when the window ports 106 are closed. The cool air (e.g., insulating air) 108 trapped on the upper part of upper condensation chamber 104 acts as an insulation layer from the hot (e.g., solar radiated) surface of the solar panel 101 above. The cool air (e.g., captured air) 110 in the lower part of upper condensation chamber 104 is not affected by the heated surface of the solar panel 101 above and is able to stay cool (e.g., prevent increases in temperature; mitigate increases in thermal energy) due to the insulation provided by the layer of cool air (e.g., insulating air) 108 trapped on the upper part of the upper condensation chamber 104.

The cool air (e.g., captured air) 110 in the lower part of upper condensation chamber 104 thus cools (e.g., decreases a temperature or thermal energy; prevents an increased in temperature or mitigates increases in thermal energy) water 115 collected in the lower condensation chamber 123. The outer surface of the lower condensation chamber 123 is exposed to the warm day temperatures outside. The cool water 115 collected inside the lower condensation chamber 123 is in contact with the wall of the lower condensation chamber 123, which on the outer side is exposed to the warm day temperatures outside (e.g., solar radiated ambient air; ambient air having the second ambient temperature). This causes droplets of water of condensation 122 to be formed on the outer surface of the lower condensation chamber 123. The lower inverted pyramid shaped condensation chamber 123 is made up of low friction glass on the outer surface, which enables easy sliding of the water droplets 122 formed on the outer surface of the lower inverted pyramid shaped condensation chamber 123 in direction 121. Alternatively, the outer surface of the inverted pyramid shaped lower condensation chamber 123 may be coated with low friction material. Thus the second step of the two-step condensation process is performed. The low friction glass surface of the lower condensation chamber 123 allows the water droplets 122 to flow down to the pointed end of the inverted pyramid 123. The water droplets 122 fall (e.g., direction 125) into a water storage system (not shown) and can be channelized into a water distribution system for various purposes such as industrial, agricultural, and other uses. The process of condensation stops when the temperature inside the lower condensation chamber 123 becomes equal to the temperature outside, which happens in the nighttime. This solar panel-interfaced unique two-step condensation system thus provides a self-sustaining, continuous process that functions with minimum supervision or human intervention.

The solar panel 100 of the present invention may further be elevated on stands, thus creating shade underneath, which would have lesser temperature than the outer area above the panel. Thus, this shaded area creates a microclimate suitable for agriculture. The water collected by condensation can be used for watering the crops. Thus, the triple purpose solar panel 100 is effectively used for harnessing solar energy for generating electric energy, formation of water from atmosphere, and usage of the solar panel and water of condensation system for agricultural purposes. The two-step condensation process ensures that water of substantially high purity is procured in this process.

The foregoing describes preferred embodiments of the invention and is given by way of example only. The invention is not limited to any of the specific features described herein but includes all variations thereof within the scope of the appended claims.

What is claimed is:

1. A triple purpose solar panel and water condensation system, comprising:

a solar panel for converting solar energy to electrical energy and a two-step water condensation system wherein, the water condensation system having an upper condensation chamber and a lower condensation chamber, the upper condensation chamber performing a first step of a two-step condensation process;

a window having window ports functioning for air transfer, the window ports being positioned on an upper part of the upper condensation chamber;

independent, self-contained, hydraulic fluid cylinders filled with hydraulic fluid, attached to the window for opening and closing of the window ports to allow for atmospheric air flow to enter inside the upper condensation chamber; and the lower condensation chamber having an inverted pyramid shape and performing a second step of the two-step condensation process, the lower condensation chamber adjacent a lower part of the upper condensation chamber.

2. The triple purpose solar panel and water condensation system of claim 1, wherein in the two-step water condensation system, the first step occurs during nighttime, at a first ambient temperature and the second step occurs during daytime, at a second ambient temperature, the second ambient temperature greater than the first ambient temperature.

3. The triple purpose solar panel and water condensation system of claim 2, wherein in the first step of the two-step condensation system, the hydraulic fluid of the hydraulic fluid cylinders contract due to the first ambient temperature, causing the window to descend such that the window ports open and radiatively cooled ambient air outside the upper condensation chamber enters the upper condensation chamber through the open window ports.

4. The triple purpose solar panel and water condensation system of claim 3, wherein in the first step of the two-step condensation system, captured air in the lower part of the upper condensation chamber decreases a temperature of water collected in the lower condensation chamber.

5. The triple purpose solar panel and water condensation system of claim 2, wherein in the second step of the two-step condensation system, the hydraulic fluid of the hydraulic fluid cylinders expand due to the second ambient temperature, causing the window to go up such that the window ports close and solar radiated ambient air outside the upper condensation chamber cannot enter the upper condensation chamber.

6. The triple purpose solar panel and water condensation system of claim 4, wherein the insulating air trapped on the upper part of the upper condensation chamber acts as an insulation layer from a heated surface of the solar panel above;

such that the captured air in the lower part of upper condensation chamber is not affected by the heated surface of the solar panel above and is able to prevent increases in temperature due to the insulation layer provided by the insulating air trapped on the upper part of the upper condensation chamber.

7. The triple purpose solar panel and water condensation system of claim 5, wherein a sealing element at the upper condensation chamber ensures proper sealing so that air transfer is not possible when the window ports are closed.

8. The triple purpose solar panel and water condensation system of claim 6, wherein the captured air in the lower part of upper condensation chamber prevents temperature increases of water collected in the lower condensation chamber which allows for condensation on an outside surface of the lower condensation chamber from contact with solar radiated ambient air.

9. The triple purpose solar panel and water condensation system of claim 1, wherein an outer surface of the inverted pyramid shaped of the lower condensation chamber is made up of low friction glass.

10. A method for a triple purpose solar panel and water condensation system, comprising:

using a solar panel for converting solar energy to electrical energy with a two-step water condensation process wherein, performing a first step of the two-step condensation process by a water condensation system having an upper condensation chamber and a lower condensation chamber, having a window with window ports functioning for air transfer, the window ports being positioned on an upper part of the upper condensation chamber;

having independent, self-contained, hydraulic cylinders filled with hydraulic fluid, attached to the windows for opening and closing of the window ports to allow for atmospheric air flow to enter inside the upper condensation chamber and performing a second step of the two-step condensation process at the lower condensation chamber having an inverted pyramid shape, the lower condensation chamber adjacent a lower part of the upper condensation chamber.

11. The method of claim 10, wherein in the two-step water condensation system, the first step occurs during nighttime, at a first ambient temperature and the second step occurs during daytime, at a second ambient temperature greater than the first ambient temperature.

12. The method of claim 11, wherein in the first step of the two-step condensation system, the hydraulic fluid of the hydraulic fluid cylinder contracts due to the first ambient temperature, causing the window to descend such that the window ports open and radiatively cooled ambient air outside the upper condensation chamber enters the upper condensation chamber through the open window ports and water vapor within the radiatively cooled ambient air condenses to form water droplets which get collected in the lower condensation chamber.

13. The method of claim 11, wherein in the second step of the two-step condensation system, the hydraulic fluid of the hydraulic fluid cylinder expands due to the second first-ambient temperature, causing the window to go up such that the window ports close and solar radiated ambient air from outside the upper condensation chamber cannot enter the upper condensation chamber.

14. The method of claim 13, wherein insulating air trapped on the upper part of the upper condensation chamber acts as an insulation layer from a heated surface of the solar panel above;

such that captured air in the lower part of upper condensation chamber is not affected by the heated surface of the solar panel above and is able to prevent a change in a temperature of the captured air due to the insulation layer provided by the insulating air trapped on the upper part of the upper condensation chamber.

15. The method of claim 13, wherein a sealing element at the upper condensation chamber ensures proper sealing so that air transfer is not possible when the window ports are closed.

16. The method of claim 14, wherein the captured air in the lower part of upper condensation chamber prevents temperature changes in water collected in the lower condensation chamber which allows for the second step of condensation when solar radiated ambient air outside the lower condensation chamber causes condensation of water droplets on an outer surface of the lower condensation chamber.

17. The method of claim 10, wherein an outer surface of the inverted pyramid shaped of the lower condensation chamber is made up of low friction glass.

18. A triple purpose solar panel and water condensation apparatus, comprising:

a solar panel and a two-step water condensation system wherein, the two-step water condensation system having an upper condensation chamber performing a first step of a two-step condensation process;

a window with window ports for air transfer, the window ports being positioned on an upper part of the upper condensation chamber;

independent, self-contained, hydraulic cylinders filled with hydraulic fluid, attached to the windows for opening and closing of the window ports to allow for atmospheric air flow to enter inside the upper condensation chamber and a lower condensation chamber having an inverted pyramid shape and performing a second step of the two-step condensation process, the lower condensation chamber adjacent a lower part of the upper condensation chamber.

19. The apparatus of claim 18, further comprising:

a sealing element at the upper condensation chamber for proper sealing so that air transfer is not possible when the window ports are closed.

20. The apparatus of claim 18, wherein an outer surface of the inverted pyramid shaped of the lower condensation chamber is made up of low friction glass.

* * * * *